US008458961B2

(12) United States Patent
Reid et al.

(10) Patent No.: US 8,458,961 B2
(45) Date of Patent: Jun. 11, 2013

(54) MODULAR WORK STATION WITH AIR COLLECTOR

(75) Inventors: James K. Reid, Gahanna, OH (US); John Reid, Royal Oak, MI (US)

(73) Assignee: Great Lakes Air Systems, Inc., Clawson, MI (US)

( * ) Notice: Subject to any disclaimer, the term of this patent is extended or adjusted under 35 U.S.C. 154(b) by 869 days.

(21) Appl. No.: 12/603,130

(22) Filed: Oct. 21, 2009

(65) Prior Publication Data

US 2010/0101155 A1 Apr. 29, 2010

Related U.S. Application Data

(60) Provisional application No. 61/106,987, filed on Oct. 21, 2008.

(51) Int. Cl.
*E04H 1/00* (2006.01)

(52) U.S. Cl.
USPC ..... 52/36.1; 52/79.1

(58) Field of Classification Search
USPC ..... 52/36.2, 36.1, 79.1, 79.5, 239; 454/193
See application file for complete search history.

(56) References Cited

U.S. PATENT DOCUMENTS

| | | | | | |
|---|---|---|---|---|---|
| 3,383,812 | A * | 5/1968 | Starr | 52/73 |
| 3,774,522 | A * | 11/1973 | Marsh | 454/187 |
| 4,026,079 | A * | 5/1977 | Morris | 52/126.7 |
| 4,409,889 | A | 10/1983 | Burleson | |
| 4,667,579 | A * | 5/1987 | Daw | 454/187 |
| 4,706,551 | A * | 11/1987 | Schofield | 454/66 |
| 4,731,961 | A * | 3/1988 | Bona | 52/63 |
| 4,733,509 | A | 3/1988 | Takahashi | |
| 4,852,309 | A * | 8/1989 | Stamp, Sr. | 52/79.6 |
| 4,883,512 | A * | 11/1989 | Griffis | 55/356 |
| 4,909,013 | A | 3/1990 | Daw et al. | |
| 4,964,899 | A * | 10/1990 | Griffis | 55/356 |
| 5,014,608 | A | 5/1991 | Benson et al. | |
| 5,029,518 | A | 7/1991 | Austin | |
| 5,293,720 | A | 3/1994 | Brice et al. | |
| 5,558,112 | A * | 9/1996 | Strieter | 134/103.2 |
| 5,807,414 | A | 9/1998 | Schafer | |
| 5,921,459 | A | 7/1999 | Heraly et al. | |
| 6,155,014 | A | 12/2000 | Wagner | |
| 6,383,241 | B1 * | 5/2002 | Janus et al. | 55/385.2 |
| 6,405,491 | B1 | 6/2002 | Gallant | |
| 6,425,219 | B1 * | 7/2002 | Barmak et al. | 52/239 |
| 6,564,512 | B1 * | 5/2003 | Whittemore | 52/37 |
| 6,786,017 | B2 * | 9/2004 | Thompson | 52/298 |
| 6,966,937 | B2 * | 11/2005 | Yachi et al. | 55/385.2 |
| 7,165,360 | B2 * | 1/2007 | Thompson | 52/36.1 |
| 7,174,678 | B2 * | 2/2007 | Gallant | 52/36.1 |
| 7,458,305 | B1 | 12/2008 | Horlander et al. | |
| 8,074,415 | B2 * | 12/2011 | Terada et al. | 52/239 |
| 2005/0005527 | A1 * | 1/2005 | Metcalf et al. | 52/36.1 |
| 2009/0107056 | A1 * | 4/2009 | Kirilichin et al. | 52/79.1 |

* cited by examiner

*Primary Examiner* — Christine T Cajilig
(74) *Attorney, Agent, or Firm* — Dickinson Wright PLLC

(57) ABSTRACT

A modular work station including a plurality of modular walls, each of which include a plurality of modular wall sections having a first and second lower frame member forming a lower frame section width and a lower frame section height. At least one lower panel element is included having a lower panel width configured to conform to the lower frame section width and is mounted to the frame members. An air collection unit is included which has an air intake width approximately equal to the lower panel width such that it may be mounted to any of the plurality of modular wall sections in place of the lower panel element.

16 Claims, 4 Drawing Sheets

MODULAR WORK STATION WITH AIR COLLECTOR

CROSS-REFERENCE TO RELATED APPLICATIONS

The present invention is a non-provisional of U.S. application Ser. No. 61/106,987 filed Oct. 21, 2008.

TECHNICAL FIELD

The present invention relates generally to a modular work station and more particular to a modular work station adapted to incorporate an air collection unit in a variety of mounting positions.

BACKGROUND OF THE INVENTION

Work stations incorporating air cleaning systems are known and utilized in a variety of industries. In many manufacturing industries, processes such as welding generate undesirable byproducts such as dust or hazardous substances. Separate work stations or work areas are often utilized to contain these substances produced during manufacturing operations.

The size and configuration of work stations for air purification can vary from small hood style arrangements to full room enclosures. In some instances the work stations or room enclosures are required to be portable. This feature allows them to be erected surrounding equipment at a given site and in addition to be moved to accommodate assembly line reconfigurations. Known structures, however, allow for relatively limited reconfigurations from their original designs. This can restrict their usage, such as when their configuration is not compatible with assembly line space limitations.

In addition, work stations with restrained design modifications may not be compatible with other production layouts. It would therefore be highly desirable to have a work station assembly that was modular in nature and could quickly and efficiently accommodate varied enclosure size and configuration.

SUMMARY OF THE INVENTION

In accordance with the objects of the present invention, a modular work station is provided. The work station includes a plurality of modular walls, each of which include a plurality of modular wall sections having a first and second lower frame member forming a lower frame section width and a lower frame section height. At least one lower panel element is included having a lower panel width configured to conform to the lower frame section width and is mounted to the frame members. An air collection unit can be provided which has an air intake width approximately equal to the lower panel width such that it may be mounted to any of the plurality of modular wall sections in place of the lower panel element. An adjustable height upper wall section having at least one upper panel element is mounted between a first and second upper frame member and is configured to engage the first and second lower frame members in a variety of positions to adjust a modular wall section height. The modular work station provides a modular unit that can be easily assembled and adjusted in width and height to accommodate a wide variety of applications and configurations.

Other objects and features of the present invention will become apparent when viewed in light of the detailed description and preferred embodiment when taken in conjunction with the attached drawings and claims.

DESCRIPTION OF PREFERRED EMBODIMENTS

Figure 1:
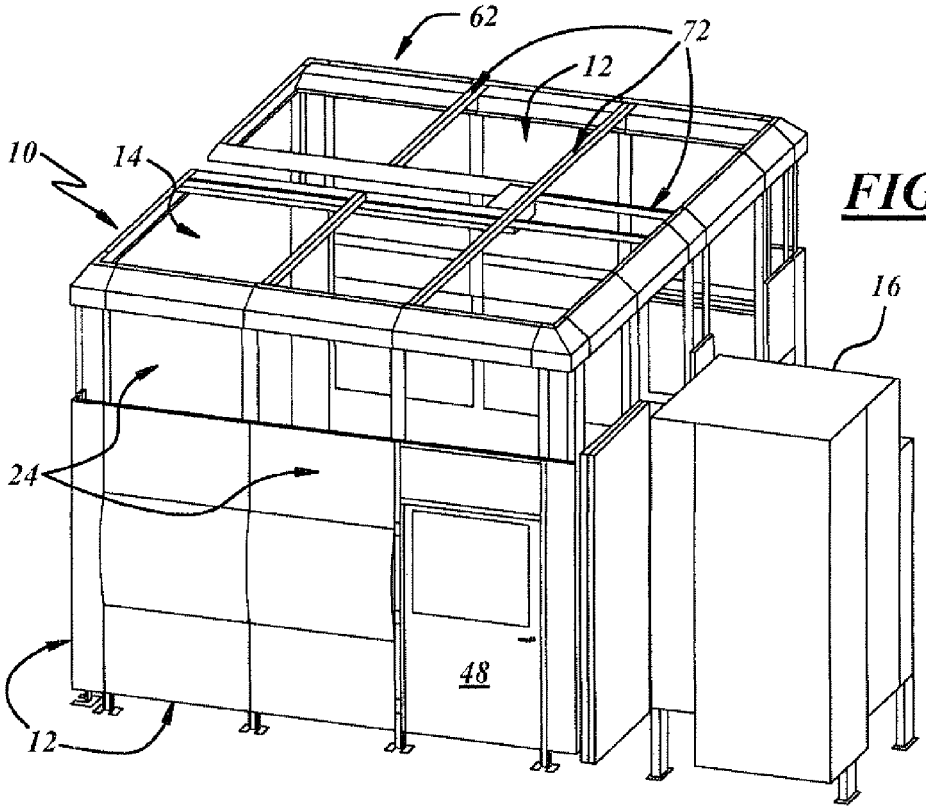
FIG. 1 is an illustration of an embodiment of a modular work station in accordance with the present invention.

Referring now to FIG. 1, which is an embodiment of a modular work station 10 in accordance with the present invention. The modular work station 10 is comprised of a plurality of modular walls 12 defining a completely (FIG. 1) or partially enclosed (FIG. 8) work area 14. It is contemplated that the modular work station 10 may be utilized for the control of airborne particulates such as those generated during welding. It should be understood, however, that one skilled in the art would comprehend a plurality of uses in view of the present disclosure.

Figure 6:
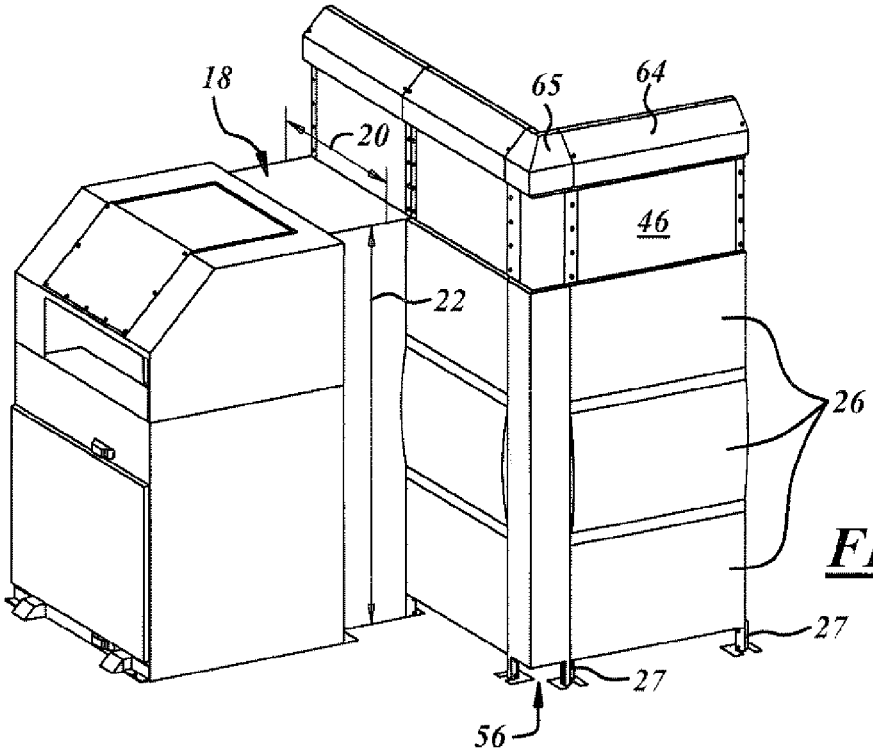
FIG. 6 is a detailed view of an air collection unit with the modular wall section illustrated in FIG. 1.

The modular workstation 10, includes an air collection unit 16 for extracting and cleaning the air contained within the work area 14. Although the present invention contemplates the use of a variety of air collection units 16, at least one embodiment contemplates the use of an air collection unit 16 having a mounting profile 18 (FIG. 6) comprised of an air intake width 20 and an air intake height 22. It should be understood that the terms air intake width 20 and air intake height 22 are intended to comprise surfaces sealingly engaged to the modular work station 10. It is contemplated that this may encompass the entire mounting surface of the air collection unit 16 or only the actual ductwork intake depending on the configuration of the particular air collection unit 16.

Each of the plurality of modular walls 12 is comprised of a plurality of modular wall sections 24. In at least one embodiment each modular wall section 24 is comprised of a lower wall section 25 secured by anchors 27 (see FIG. 4). The lower wall section 25 in turn is comprised of a least one lower panel element 26 having a lower panel width 28. The lower panel element 26 may be mounted to and span between a first and second lower frame member 30, 32 positioned to define a lower frame section width 34 and a lower frame section height 36. The lower panel element 26 may be mounted with a variety of attachment methodologies including, but not limited to, the use of sheet metal screws, weld attachments, bolts, etc. The lower frame section height 36 may be covered by a single mounted lower panel element 26 or a plurality of lower panel elements 26. The lower panel elements 26 may be clear or opaque.

Figure 2:
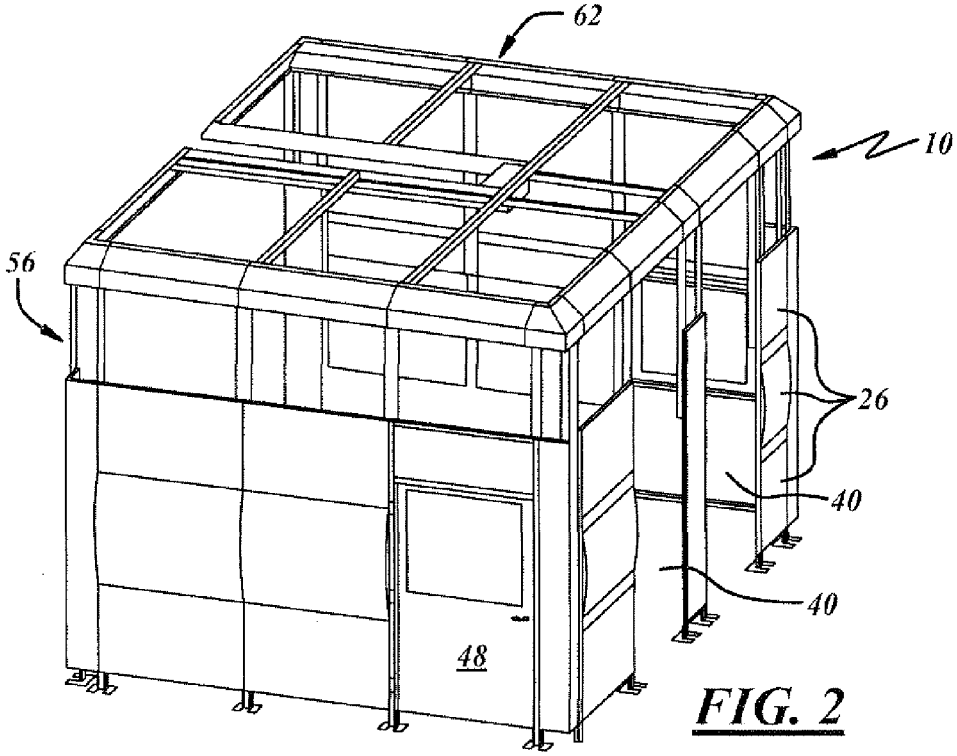
FIG. 2 is the modular work station system in accordance with FIG. 1, the modular work station illustrated with the air collection unit removed.

A unique feature of the present invention is that the air collection unit 16 has an intake or mounting profile configured such that it can be mounted to any of the modular wall sections 24 in place of the lower panel element(s) 26. In one embodiment, this is accomplished by the air intake width 20 being approximately equal to the lower panel width 28. This unique configuration allows the air collection unit 16 to be mounted quickly and easily on any of the modular wall sections 24 by simply removing the lower panel element(s) 26 to generate an opening 40 and installing the air collection unit 16 (see FIG. 2). In a similar fashion, a door unit 48 may be mounted within an opening 40 formed by removing the lower panel element(s) 26.

Figure 3:
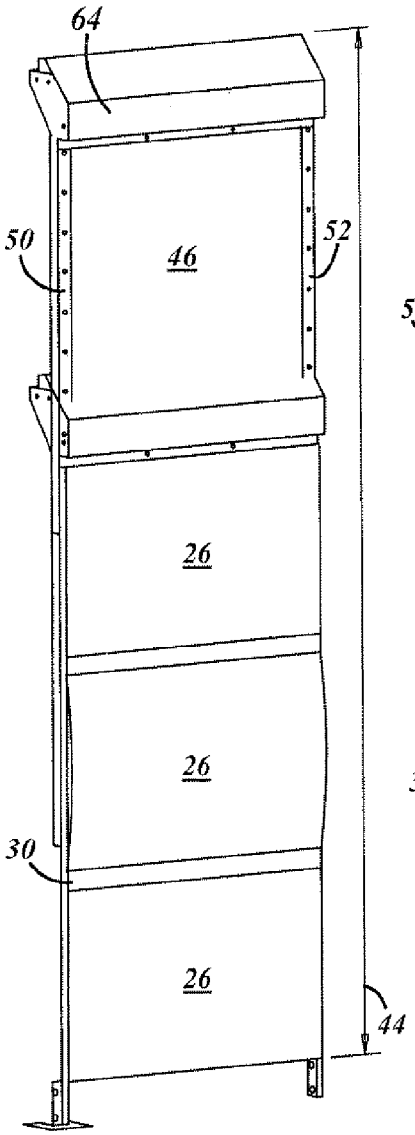
FIG. 3 is a detail of a modular wall section for use with the modular work station illustrated in FIG. 1.
Figure 4:
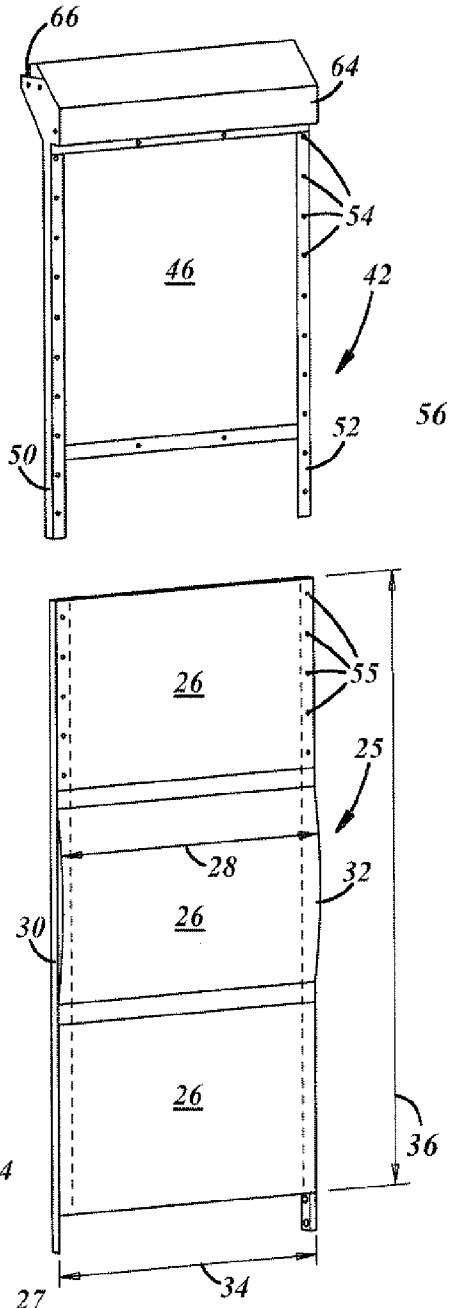
FIG. 4 is an exploded view detail of the modular wall section illustrated element in FIG. 3.

The present invention provides additional advantages in addition to the flexibility of air collection unit 16 installation. The plurality of modular wall sections 24 preferably comprise adjustable height wall sections. Although this may be accomplished in a variety of fashions, one embodiment contemplates the use of an adjustable height upper wall section 42 to allow the modular work station 10 to accommodate a wide variety of machinery by modifying the modular wall section height 44 (FIG. 3-4).

An embodiment of the present invention contemplates having at least one upper panel element 46 movably mounted in communication with either the lower panel element(s) 26, the air collection unit 16, or even the door unit 48 (FIG. 1). This can be accomplished through the use of a first and second upper frame member 50, 52 configured to engage the first and second lower frame members 30, 32 in a variety of positions. The upper panel element 46 is mounted between the upper frame members 50, 52 and is preferably in communication with a surface of the lower panel element 26 so as to allow a range of vertical extensions of the lower panel element 46 (FIG. 3-4). The upper frame members 50, 52 of the disclosed embodiment have a plurality of upper member holes 54 which can mate with a similar plurality of lower member holes 55 in the lower frame members 30, 32. Once the holes are aligned, bolts can be inserted and secured by nuts or other fasteners. A variety of connection methodologies are contemplated including, but not limited to, sheet metal screws or spring loaded clips.

Figure 5:
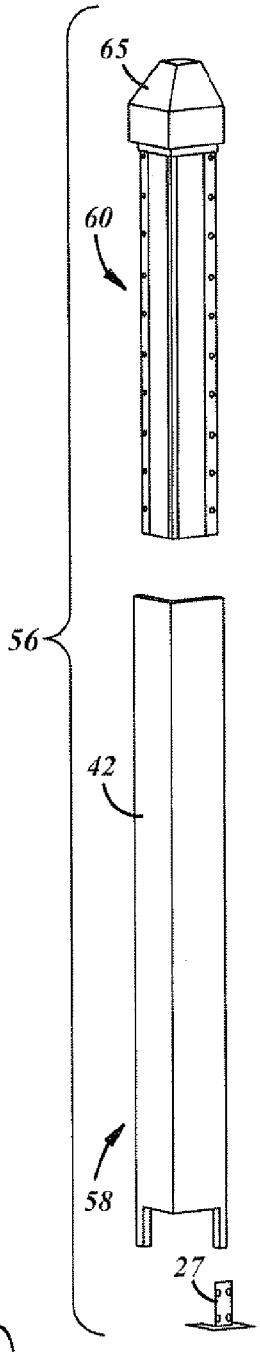
FIG. 5 is an exploded view detail of a corner post for use with the modular work station illustrated in FIG. 1.

Adjoining modular walls 12 or wall panels 24 may be connected by affixing adjoining frame members together. Alternatively, adjoining modular walls 12 or wall panels 24 may share frame members. In addition, the present invention may further include a plurality of corner posts 56 including a lower corner post section 58 and an adjustable height upper corner post section 60 (FIG. 5). The corner posts 56 may be utilized between the plurality of modular walls 12 to increase the structural integrity and continuity of the modular work station 10. In addition, it is contemplated that the present invention may include ceiling assembly 62 including a plurality of hood sections 64 aligned to form a unitary hood around the perimeter of the modular work station 10 (FIGS. 3-7). Corner hood sections 65 may be mounted to the upper corner post sections 60 to further establish the continuity of the unitary hood. A portion of the hood sections 64 may be mounted to the upper wall sections 42 such that they angle inwards towards the work area 14. The hood sections 64 may be utilized in regions without modular walls 12 by mounting a plurality of such hood sections 64 to each other.

Figure 8:
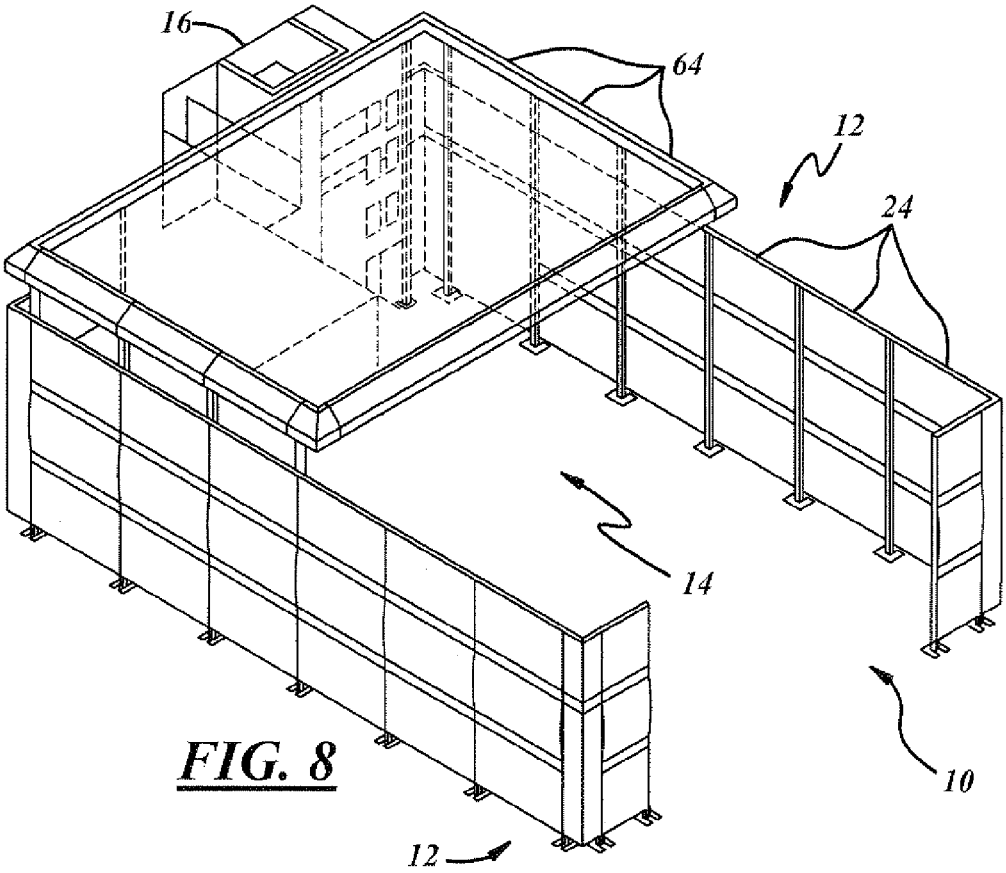
FIG. 8 is an alternate configuration of the modular work station illustrated in FIG. 1.
Figure 7:
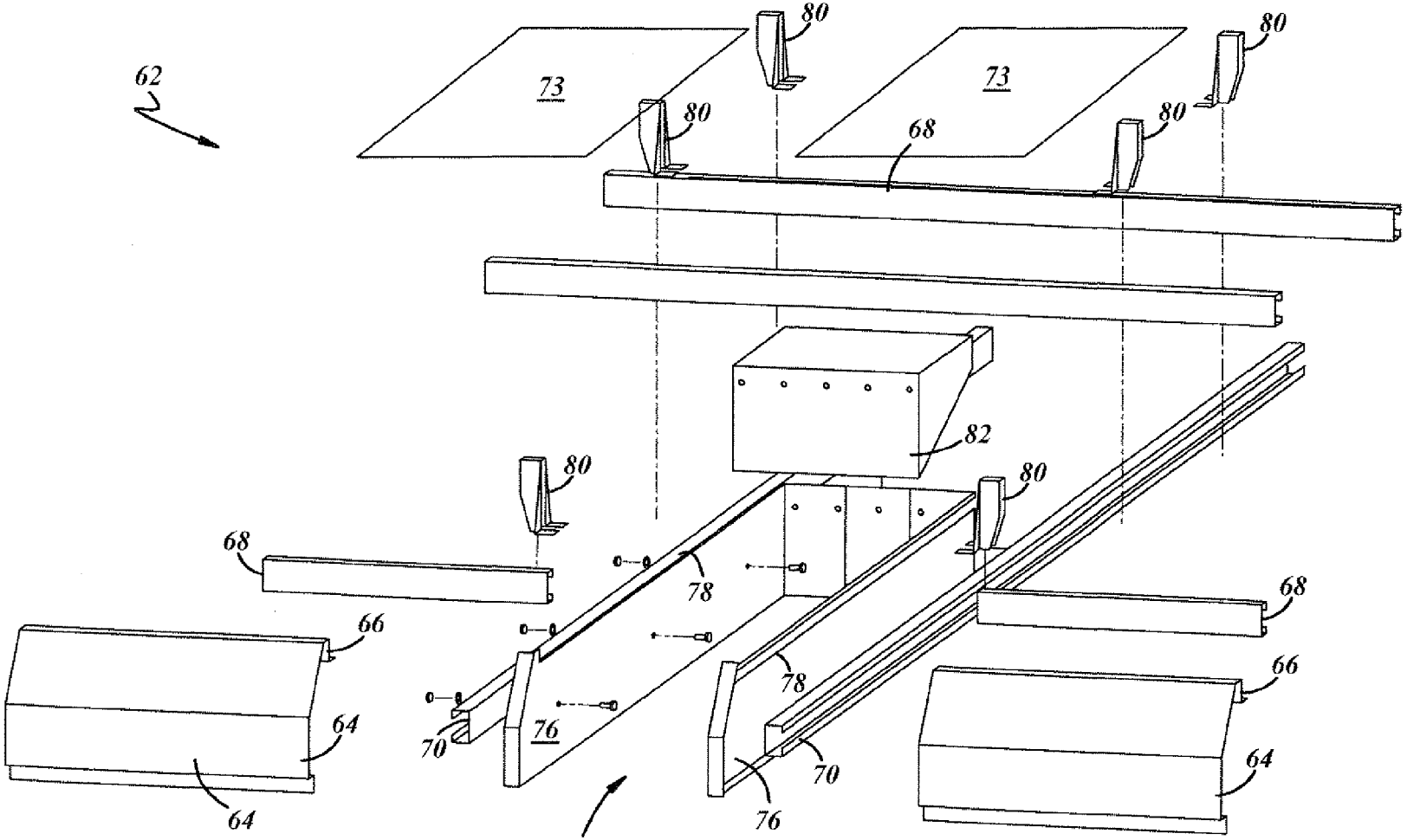
FIG. 7 is an exploded view detail of a ceiling assembly for use with the modular work station illustrated in FIG. 1, the illustrated ceiling assembly allowing access to the enclosure for an overhead crane or hoist.

The hood sections 64 preferably incorporate a support ledge 66 (FIG. 3) formed therein. A plurality of lateral support members 68, 70 form a ceiling frame 72 supported by the support ledge 66 (FIGS. 1, 7). Although a variety of support members 68, 70 are contemplated, one embodiment contemplates the use of C-shaped support members 68, 70. One or more ceiling panels 73 may be mounted to the support member 68, 70 to enclose the work area 14 and facilitate the extraction of air (FIGS. 7-8). While a variety of ceiling panels 73 are contemplated, the use of a clear polycarbonate top such as Lexan panels would improve light and visibility within the work area 14.

The ceiling assembly 62 may further include a crane slot assembly 74 to facilitate the use of external support cranes (FIG. 7). The use of such cranes is known in the art. The present invention, however, creates a crane slot assembly 74 through the use of a pair of crane slot support arms 76 mounted to said support members 68, 70. The crane slot support arms 76 preferably each include an upper support arm ledge 78 formed therein. S-shaped fasteners 80 configured to fit over the ends of the lateral support members 68, 70, and under the upper support arm ledge 78 may be used to secure support members 68 to the upper support arm ledge 78. Sheet metal screws or other attachment methodologies may be utilized to secure the lateral support members 68 to the crane slot support arms 76. A crane slot housing 82 may further be positioned in-between and secured to the crane slot support arms 76.

The present invention provides a modular work station 10 that is easy to ship, construct and is versatile. The various components can be shipped disassembled and then assembled at the desired location, which greatly reduces costs and makes installation very easy. The workstation and air collector of the present invention can be very quickly set up, taken down, and re-arranged with the top at a different height, if desired.

The modular work station 10 of the present invention is also versatile because it can be changed to fit different requirements. The air collector 16 can be moved by merely removing a lower panel element 26, moving the air collector 16 and reinstalling the panel 26 at the prior location of the air collector 16. Additionally, the dimensions of the modular work station 10 can be easily changed. The height can be adjusted by merely moving the adjustable height upper wall sections 42 with respect to the lower wall sections 25. The size of the modular work station 10 can also be easily changed by merely adding or removing modular wall sections 24 as desired.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A modular work station comprising:

a plurality of modular walls, each of said plurality of modular walls comprising:

a plurality of modular wall sections each comprising:

a first and second lower frame member forming a lower frame section width and a lower frame section height; and at least one lower panel elements having a lower panel width configured to mount to said first and second lower frame member;

an adjustable height upper wall section having at least one upper panel element mounted between a first and second upper frame member, said first and second upper frame members configured to engage said first and second lower frame members in a variety of positions to adjust a modular wall section height;

a hood section mounted to said first and second upper frame members, said hood section configured to protrude towards a work area of the modular work station;

a plurality of corner posts mounted to said plurality of modular walls, each comprising a lower corner post section, adjustable height upper corner post section and a corner hood section, said corner hood section configured to engage neighboring hood sections to form a contiguous workstation hood.

2. A modular work station as described in claim 1, wherein said hood section further comprises:

a support ledge formed therein.

3. A modular work station as described in claim 2, further comprising:

a ceiling assembly comprising:

a plurality of lateral support members, said plurality of lateral support members forming a ceiling frame supported by said support ledge.

4. A modular work station as described in claim 3, wherein said plurality of lateral support members comprise C-shaped channels.

5. A modular work station as described in claim 3, further comprising:

a plurality of ceiling panels mounted to said plurality of lateral support members.

6. A modular work station as described in claim 3, further comprising:

a crane slot assembly mounted within said ceiling assembly, said crane slot assembly comprising:

a pair of crane slot support arms each including an upper support arm ledge; and a crane slot housing mounted to said pair of crane slot support arms.

7. A modular work station as described in claim 6, wherein said pair of crane slot support arms are mounted to said lateral support members by way of shaped fasteners configured to mount over a lateral support member end and under said upper support arm ledge.

8. A modular work station comprising:

a plurality of modular walls, each of said plurality of modular walls comprising:

a plurality of modular wall sections having at least one lower panel element; and an air collection unit having a mounting profile configured to match the profile of one or more of said lower panel elements such that it may be mounted to any of said plurality of modular wall sections in place of said lower panel elements;

a plurality of hood sections each mounted to one of said plurality of modular wall sections and configured to protrude towards a work area of the modular work station;

a plurality of corner posts mounted to said plurality of modular walls, each comprising a lower corner post section, adjustable height upper corner post section and a corner hood section, said corner hood section configured to engage neighboring hood sections to form a contiguous workstation hood.

9. A modular work station as described in claim 8, wherein said plurality of modular wall sections comprise adjustable height wall sections.

10. A modular work station as described in claim 9, wherein said adjustable height wall sections each comprise an adjustable height upper wall section having at least one upper panel element positioned in communication with a surface of said lower panel element, said upper panel element vertically movable relative to said lower panel element to adjust a modular wall section height.

11. A modular work station as described in claim 8, further comprising:

a ceiling assembly comprising:

a plurality of lateral support members forming a ceiling section supported by a support ledge formed in said plurality of hood sections.

12. A modular work station as described in claim 11, further comprising:

a plurality of clear ceiling panels mounted to said plurality of lateral support members.

13. A modular work station as described in claim 11, further comprising:

a crane slot assembly mounted within said ceiling assembly, said crane slot assembly comprising:

a pair of crane slot support arms each including an upper support arm ledge;

a crane slot housing mounted to said pair of crane slot support arms; and a plurality of S-shaped fasteners configured to mount over a lateral support member end and under said upper support arm ledge, said plurality of s-shaped fasteners mounting pair of crane slots support arms to said lateral support members.

14. A modular work station comprising:

a plurality of modular walls, each of said plurality of modular walls comprising:

a plurality of modular wall sections each comprising:

a first and second lower frame member forming a lower frame section width and a lower frame section height; and at least one lower panel elements having a lower panel width configured to mount to said first and second lower frame member;

an adjustable height upper wall section having at least one upper panel element mounted between a first and second upper frame member, said first and second upper frame members configured to engage said first and second lower frame members in a variety of positions to adjust a modular wall section height;

a hood section mounted to said first and second upper frame members, wherein said hood section further comprises a support ledge formed therein, said hood section configured to protrude towards a work area of the modular work station;

a ceiling assembly comprising;

a plurality of lateral support members, said plurality of lateral support members forming a ceiling frame supported by said support ledge;

plurality of lateral support members comprise C-shaped channels;

a plurality of ceiling panels mounted to said plurality of lateral support members;

a crane slot assembly mounted within said ceiling assembly, said crane slot assembly comprising:

a pair of crane slot support arms each including an upper support arm ledge;

a crane slot housing mounted to said pair of crane slot support arms; and wherein said pair of crane slot support arms are mounted to said lateral support members by way of S-shaped fasteners configured to mount over a lateral support member end and under said upper support arm ledge.

15. A modular work station as described in claim 14, further comprising:

a plurality of corner posts mounted to said plurality of modular walls, each comprising a lower corner post section and adjustable height upper corner post section.

16. A modular work station as described in claim 14, further comprising: a plurality of corner posts mounted to said plurality of modular walls, each comprising a lower corner post section, adjustable height upper corner post section and a corner hood section, said corner hood section configured to engage neighboring hood sections to form a contiguous workstation hood.

* * * * *